US008800771B2

(12) United States Patent
Alvares et al.

(10) Patent No.: US 8,800,771 B2
(45) Date of Patent: Aug. 12, 2014

(54) CONTAINER FOR PRESSURIZED FLUIDS

(75) Inventors: Antonio Carlos Teixeira Alvares, Sao Paulo-SP (BR); Silverio Candido Da Cunha, Lajeado-Rs (BR)

(73) Assignee: Brasilata S/A Embalagens Metalicas, Sao Paulo-SP (BR)

( * ) Notice: Subject to any disclaimer, the term of this patent is extended or adjusted under 35 U.S.C. 154(b) by 380 days.

(21) Appl. No.: 12/675,821

(22) PCT Filed: Sep. 3, 2008

(86) PCT No.: PCT/BR2008/000270

§ 371 (c)(1),
(2), (4) Date: May 26, 2010

(87) PCT Pub. No.: WO2009/030009

PCT Pub. Date: Mar. 12, 2009

(65) Prior Publication Data

US 2010/0300916 A1 Dec. 2, 2010

(30) Foreign Application Priority Data

Sep. 3, 2007 (BR) ..... 0703846

(51) Int. Cl.
*B65D 85/62* (2006.01)
*B65D 83/38* (2006.01)
*B65D 21/02* (2006.01)

(52) U.S. Cl.
CPC ..... *B65D 21/0231* (2013.01); *B65D 83/38* (2013.01)
USPC ..... 206/503; 206/509; 220/619; 220/620

(58) Field of Classification Search
USPC ..... 220/4.12, 309.1, 319, 608, 619, 620, 220/609; 206/509, 203, 511, 512, 508, 503, 206/504
See application file for complete search history.

(56) References Cited

U.S. PATENT DOCUMENTS

| | | | | |
|---|---|---|---|---|
| 1,083,574 | A * | 1/1914 | Westerbeck | 220/309.1 |
| D256,652 | S * | 9/1980 | Leung et al. | D7/608 |
| 5,492,245 | A * | 2/1996 | Kalkanis | 220/609 |
| 6,095,332 | A * | 8/2000 | Finand et al. | 206/503 |
| 6,142,330 | A | 11/2000 | Sacks | |
| 6,578,724 | B1 | 6/2003 | Owens | |
| 7,732,035 | B2 * | 6/2010 | Pedmo et al. | 428/66.3 |

FOREIGN PATENT DOCUMENTS

| | | |
|---|---|---|
| JP | 11301757 | 11/1999 |

* cited by examiner

*Primary Examiner* — Jeffrey Allen
(74) *Attorney, Agent, or Firm* — Fish & Richardson P.C.

(57) ABSTRACT

A container having a tubular body including a side wall, a bottom wall in the form of a spherical dome projecting to the interior of the container, and an upper wall in the form of an annular spherical dome, inferiorly attached to the side wall by an upper double seam. The bottom wall includes at least one seating region having a predetermined circumferential extension along a plane extending transversely with respect to an axis of the container and being axially spaced inwardly within the side wall of the container, the seating region being configured to be fitted around a respective circumferential extension a upper double seam of an identical and adjacent container inferiorly disposed in a vertical stack, and axially seated on said upper double seam, so as to define a single contact region between two vertically stacked containers.

14 Claims, 13 Drawing Sheets

CONTAINER FOR PRESSURIZED FLUIDS

CROSS-REFERENCE TO RELATED APPLICATIONS

This application is a US National Phase Application under 35 U.S.C. §371 of International Patent Application No. PCT/BR2008/000270 filed Sep. 3, 2008, which claims priority from Brazilian Patent Application No. PI0703846-1, filed Sep. 3, 2007, each of which are hereby incorporated by reference in their entireties. The International Application published in the English language as WO 2009/030009 A1 on Mar. 12, 2009.

FIELD OF THE INVENTION

The present invention refers to a container constructed in sheet metal and of the type usually used as a device for containing and applying gas pressurized fluids, by means of a spray valve, as it occurs with the aerosols. The invention is particularly related to the construction of the container lower wall, which is usually configured in an inwardly-facing spherical dome, so that the container can be safely vertically stacked onto the other containers presenting the same construction.

PRIOR ART

There are well known from the prior art the containers for aerosols, gases and similar fluid mixtures, presenting a tubular body formed in sheet metal and comprising: a cylindrical side wall; a bottom wall in the form of a spherical dome projecting to the interior of the container and attached to the side wall by a lower double seam; and an upper wall, in the form of an annular spherical dome, projecting outwardly from the container, and inferiorly attached to the side wall by an upper double seam and defining a central opening in which is adapted the typical valve to be actuated by the final user, to release a jet of sprayed fluid.

The known container construction mentioned above, presenting lower and upper walls in the form of a spherical dome, causes difficulty in stacking said containers in the vertical position, with the bottom wall of a container seating onto the upper wall or on the lid of the container immediately below in the stack.

The vertical stacking of these containers is desirable in different moments, from the formation of the container, still without the spray valve, until its placement in the point of sale to the consumer.

As is known, these containers are produced in sheet metal, and packaged and sent to the filling company (filler) to be filled with the product (pressurized fluid), still deprived of the spray valve. The packaging of these containers at the can manufacturer, to be transported to the filling company, requires the provision of sheets, generally made of cardboard, which are seated on the upper wall of each layer of containers (still without the valve and the lid) which are disposed vertically side by side in the interior of a box or other type of package, the upper layer of containers being seated on the intermediary support sheet, and then successively until the number of layers in each package is completed.

Although allowing stacking multiple layers of vertically disposed containers, this prior art solution presents the inconveniences of requiring the provision of the intermediary support sheet and not providing a mutual retention or locking against relative horizontal (radial) displacements between the containers stacked on top of one another, permitting the occurrence of undesirable shocks between the side walls, which are externally lithographed with the promotional messages that identify the stored product and its manufacturer. These shocks can damage the outer finishing of the cylindrical side wall of these containers, particularly when the lower double seam of a container hits the side wall of an adjacent container. As a consequence of this inconvenience, it is generally applied a solution to reduce the degree of damage of the containers, due to the side shocks which occur in the handling and shipping to the filler. The solution consists in deforming the lower double seam inwards, to maintain it inside the axial projection of the cylindrical contour of the can, which requires an additional and relatively complex operation in the production of said containers. Besides not allowing a safe vertical stacking between the containers still deprived of the spray valve, as a function of the spherical dome shape of the bottom wall and the upper wall, particularly the shape of the bottom wall, the containers of the type considered herein are not safely vertically stackable as well, after receiving the spray valve and the known upper lid in the filler.

Although the upper lid presents a general cylindrical inverted cup shape, with a side wall fitted around the upper double seam and with a flat top wall covering, with an axial gap, the upper wall and the valve already installed therein, the spherical dome shape of the bottom wall of the container prevents it from being safely fitted, with radial locking, on the lid of a container disposed immediately below, in a vertical stack. This feature of the current containers jeopardizes and increases the cost of packaging and transportation of the containers, from the filler to the point of sale, and further leads to limitations in the arrangement of the containers to be displayed to the final consumer, for example, in gondolas or shelves.

SUMMARY OF THE INVENTION

As a function of the limitations of stacking the known containers for pressurized fluids, it is an object of the present invention to provide a type of container which is structurally resistant to high inner pressure, without requiring increasing the sheet metal thickness and which can be safely stacked in a vertical position, directly over an identical container stacked below, both in a condition deprived of the spray valve and upper lid and in a condition in which the already filled containers are provided with the usual upper lid covering the spray valve.

It is a further object of the invention to provide a container, as mentioned above and which can present its lower double seam projecting radially outwards from the axial projection of the side wall contour of the tubular body of the container, without this fact incurring damage to the outer lithography of these containers when stored and transported in side-by-side vertical stacks.

The above-mentioned objects, and others to be treated along the present specification, are achieved with a container of the type which comprises: a cylindrical side wall, having a lower edge and an upper edge which presents a reduced diameter; a bottom wall in the form of a spherical dome projecting to the interior of the container and attached to the lower edge of the side wall by a lower double seam; an upper wall in the form of an annular spherical dome, which is inferiorly attached to the upper edge of the side wall by an upper double seam and defining a central opening.

According to the invention, the bottom wall is conformed to define, in a single piece, at least one seating region having a determined circumferential extension disposed according to a plane transversal to the axis of the container and axially spaced back in relation to the lower double seam, said seating region being fitted and axially seated, respectively, around and on a respective circumferential extension of the upper double seam of an identical and adjacent container inferiorly disposed in a vertical stack, so as to define a single contact region between two vertically stacked containers.

The seating region of the bottom wall of a container is constructed so as to be also fitted around a respective circumferential extension of an upper edge region of the side wall of a lid mounted on a container inferiorly disposed in a stack, said seating region being also axially seated on a peripheral region of a top wall of said lid.

The construction proposed herein allows the bottom wall of a container to be fitted and locked, in the radial direction, on the upper double seam of a container, still without the spray valve and the lid, and which is disposed immediately below in a stack or also on the upper edge region of a lid fitted on said inferiorly disposed container, preventing the relative transversal displacement between the two containers.

BRIEF DESCRIPTION OF THE DRAWINGS

The invention will be described below, with reference to the enclosed drawings, given by way of example and in which.

DETAILED DESCRIPTION OF THE INVENTION

As illustrated and previously mentioned, the invention refers to a container R of the type used for storing and applying pressurized fluids, such as aerosols and the like, which require containers in the form of cylindrical cans constructed to resist high inner pressures.

The container R, of the type considered herein, presents a tubular body 1, formed in sheet metal and comprising a cylindrical side wall 10 which is externally provided with messages allusive to the packaged product and its manufacturer and generally obtained by lithography, said side wall 10 having a lower edge 10*a* and an upper edge 10*b* with a reduced diameter in relation to the diameter of the side wall 10.

Figure 1:
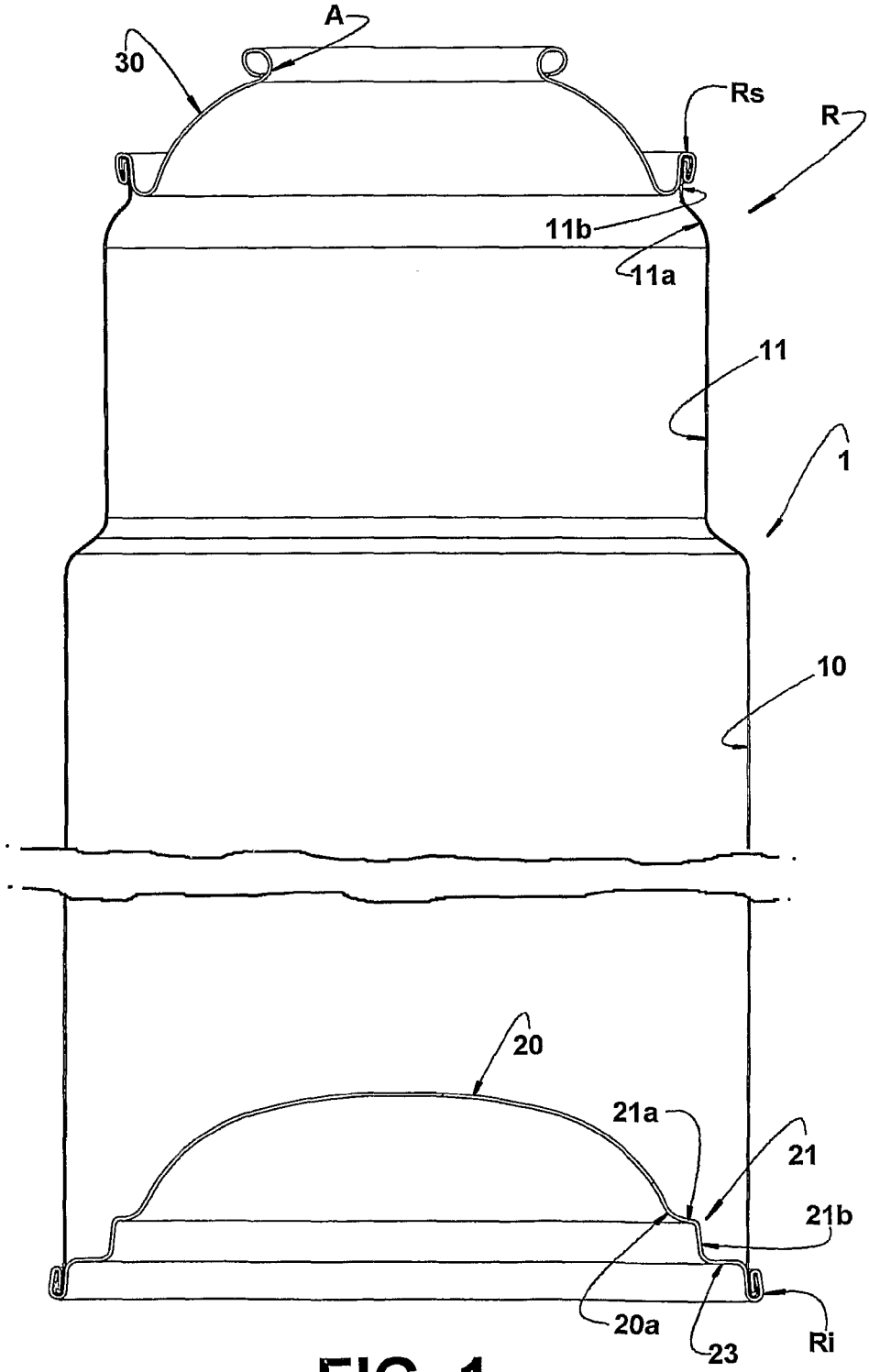
FIG. 1 represents a longitudinal diametrical sectional view of a container constructed according to the invention, deprived of the spray valve and the lid, and illustrating a first embodiment for the bottom wall.
Figure 2:
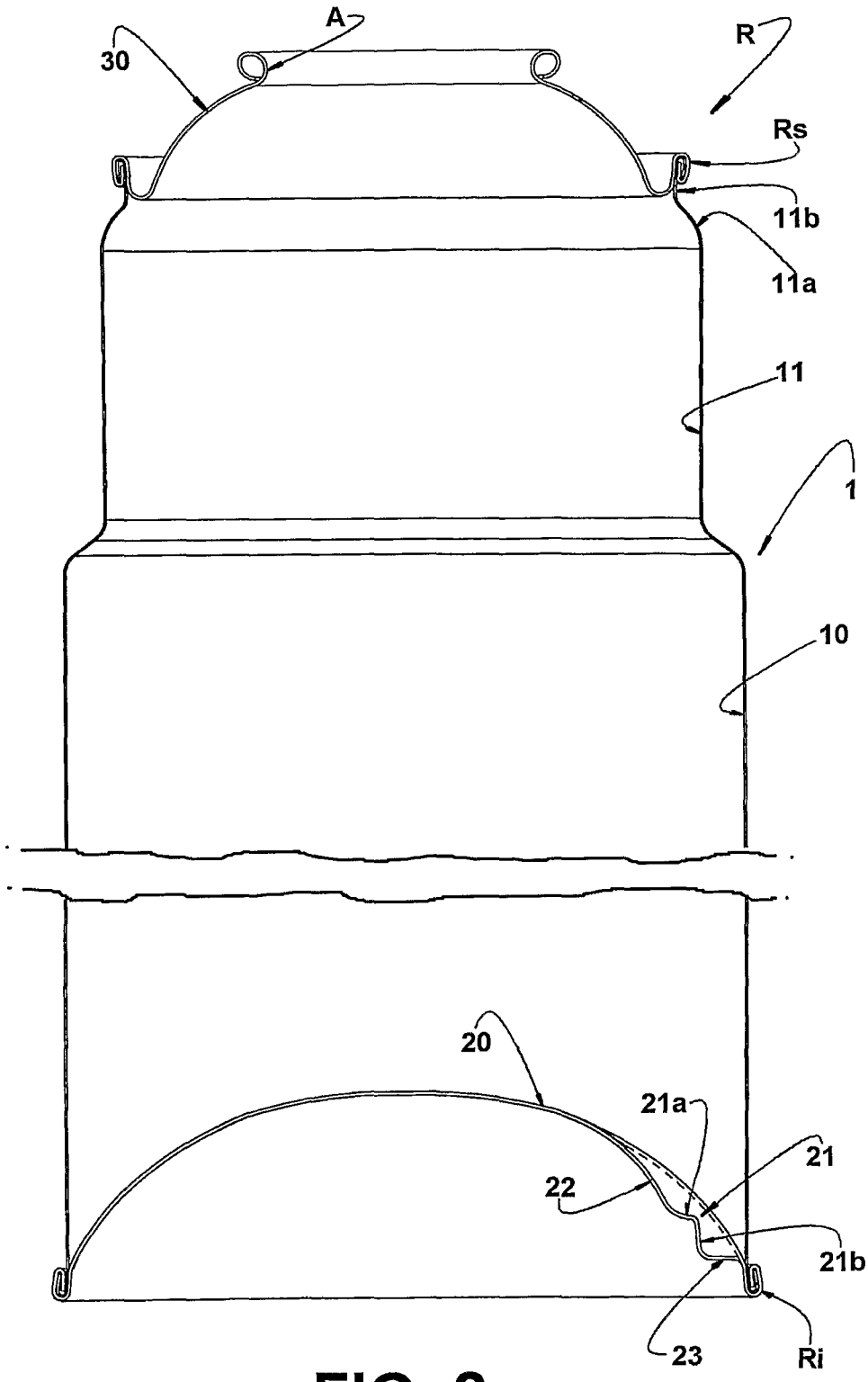
FIG. 2 represents a longitudinal diametrical sectional view of a container constructed according to the invention, deprived of the spray valve and the lid, and illustrating a second embodiment for the bottom wall.
Figure 2A:
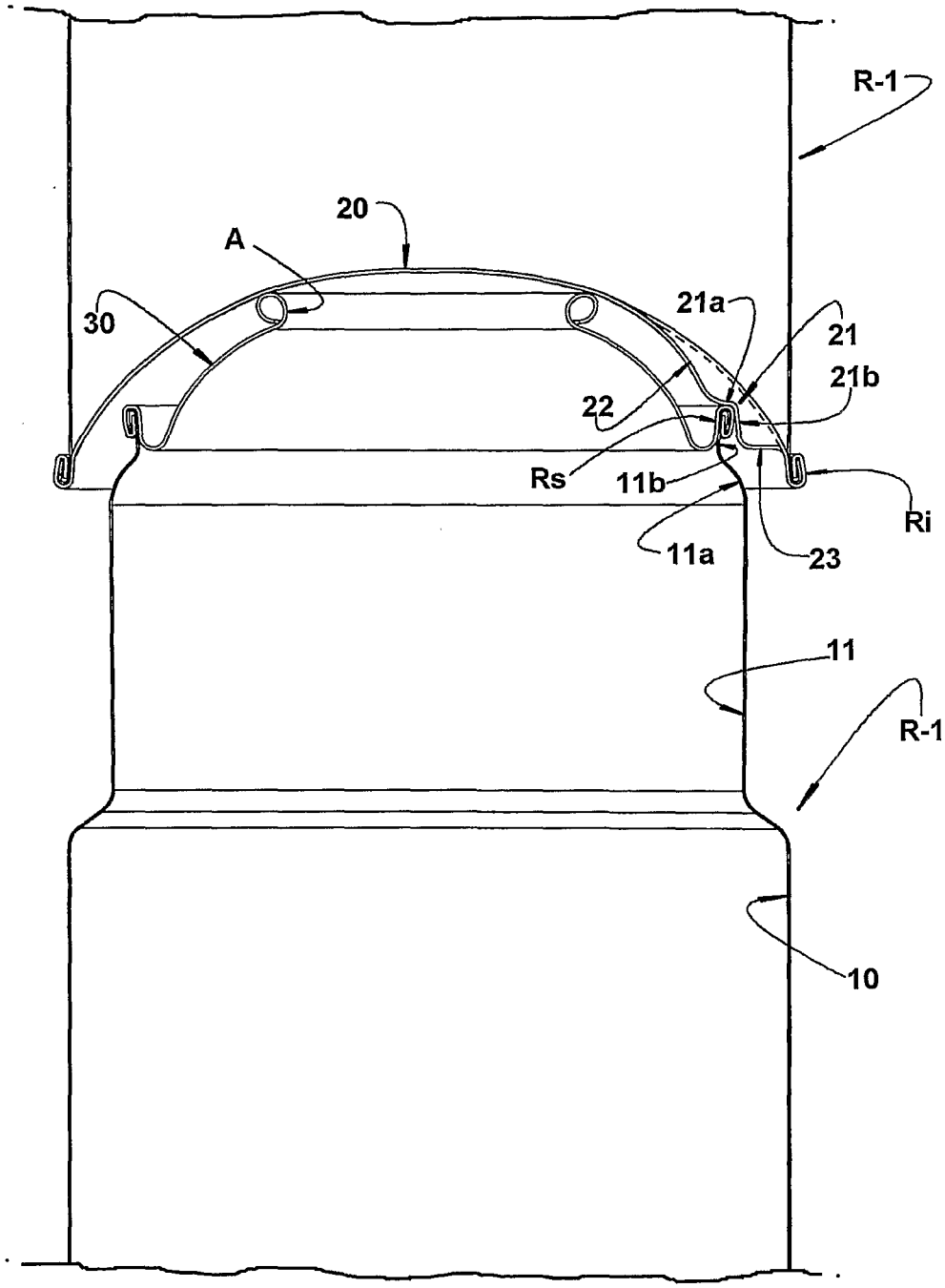
FIG. 2A represents an enlarged diametrical sectional view of the lower portion of a container, as defined in FIG. 2 and with a bottom wall seated on the upper double seam of a container presenting the same construction.
Figure 2B:
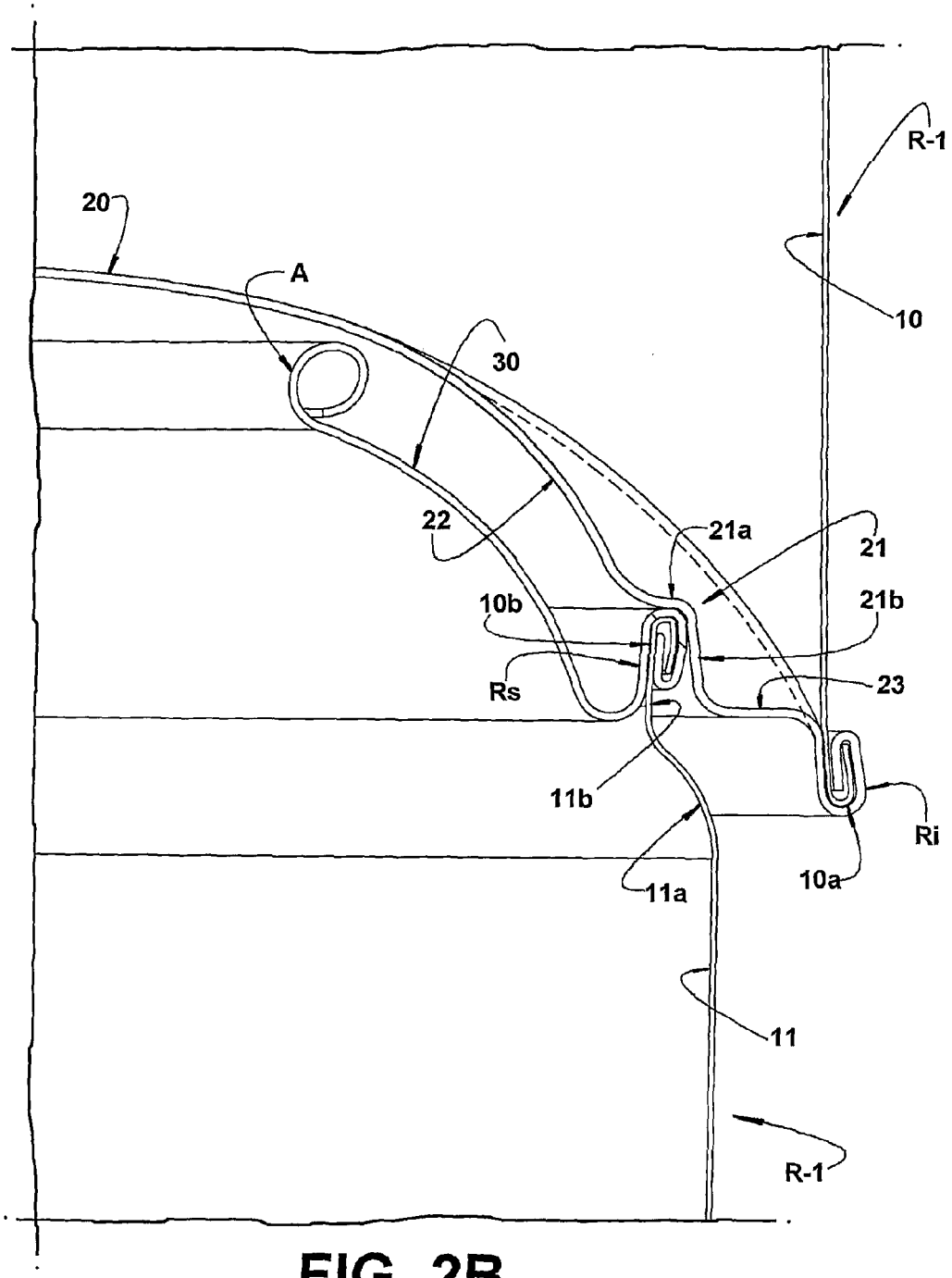
FIG. 2B represents an enlarged detail of part of FIG. 2A, to better illustrate the construction of the bottom wall and its seating on the upper double seam of the container inferiorly disposed in a stack.
Figure 2C:
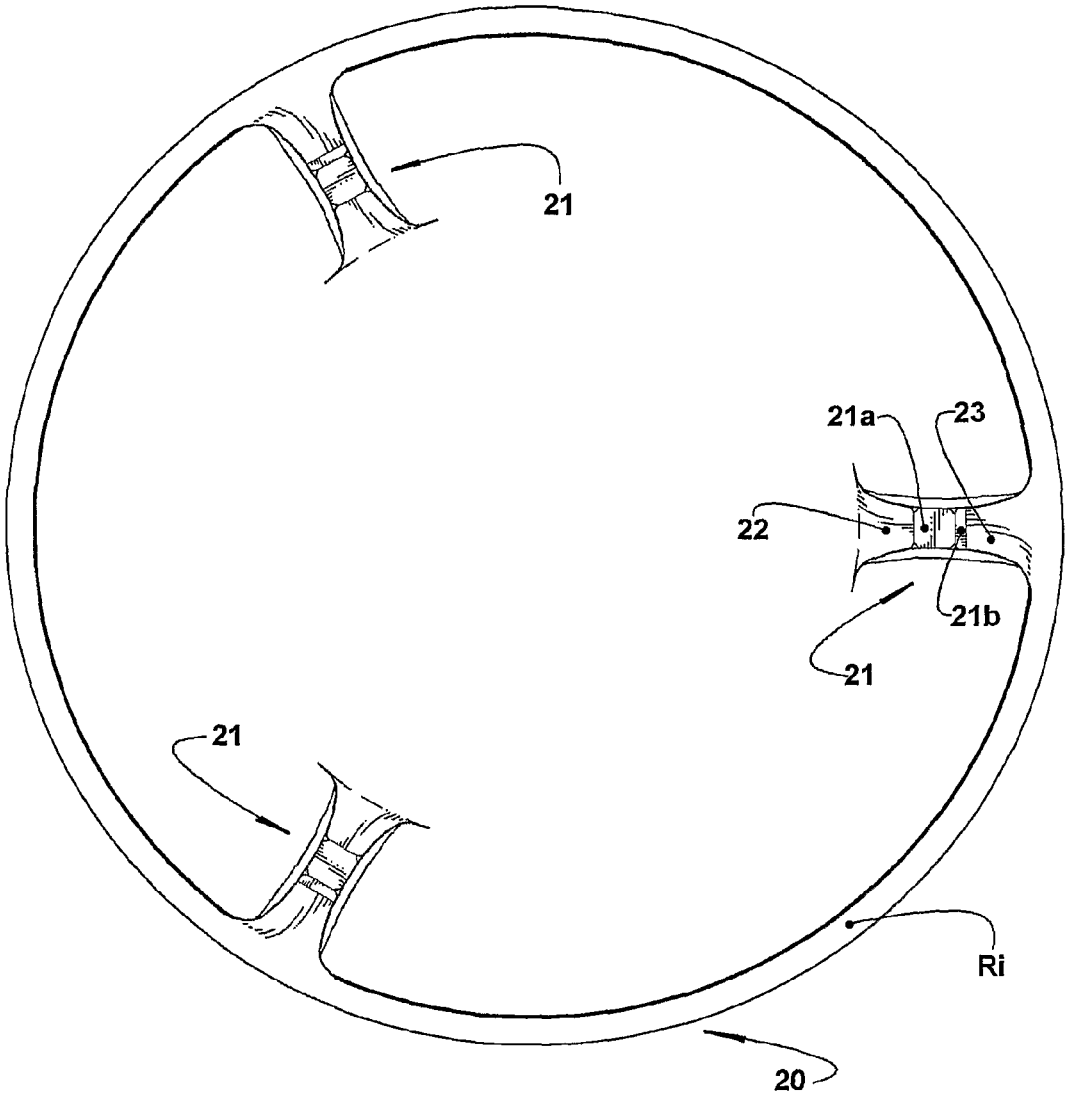
FIG. 2C represents a slightly enlarged bottom plan view of the first embodiment of the bottom wall, as illustrated in FIGS. 2, 2A and 2B.

These containers R have the side wall 10 thereof occupying two-third of the total height of said container R, the upper one-third area of the container R presenting an upper cylindrical portion 11 with a reduced diameter in relation to the diameter of the side wall 10 of the tubular body 1, said upper cylindrical portion 11 superiorly presenting a diametrical reduction, generally in a convex arc 11*a*, for transition to a cylindrical neck 11*b*, in whose upper end is defined the upper edge 10*b* of the side wall 10. Therefore, the upper edge 10*b* of the side wall 10 presents a substantially reduced diameter in relation to the diameter of the side wall 10, as well illustrated in FIGS. 1, 2 and 3.

The tubular body 1 further comprises a bottom wall 20, in the form of a spherical dome projecting to the interior of the container R, which is attached to the lower edge 10*a* of the side wall 10, by a lower double seam Ri formed in a conventional way, i.e., projecting radially outwards from the axial projection of the contour of the side wall 10 of the tubular body 1. The tubular body 1 further comprises an upper wall 30 in the form of an annular spherical dome, projecting outwards from the tubular body 1, inferiorly attached to the upper edge 10*b* of the side wall 10 by an upper double seam Rs and defining a central opening A positioned in a plane transversal to the longitudinal axis of the container R and upwardly displaced in relation to the plane in which is situated the upper edge 10*b* of the side wall 10.

Figure 3:
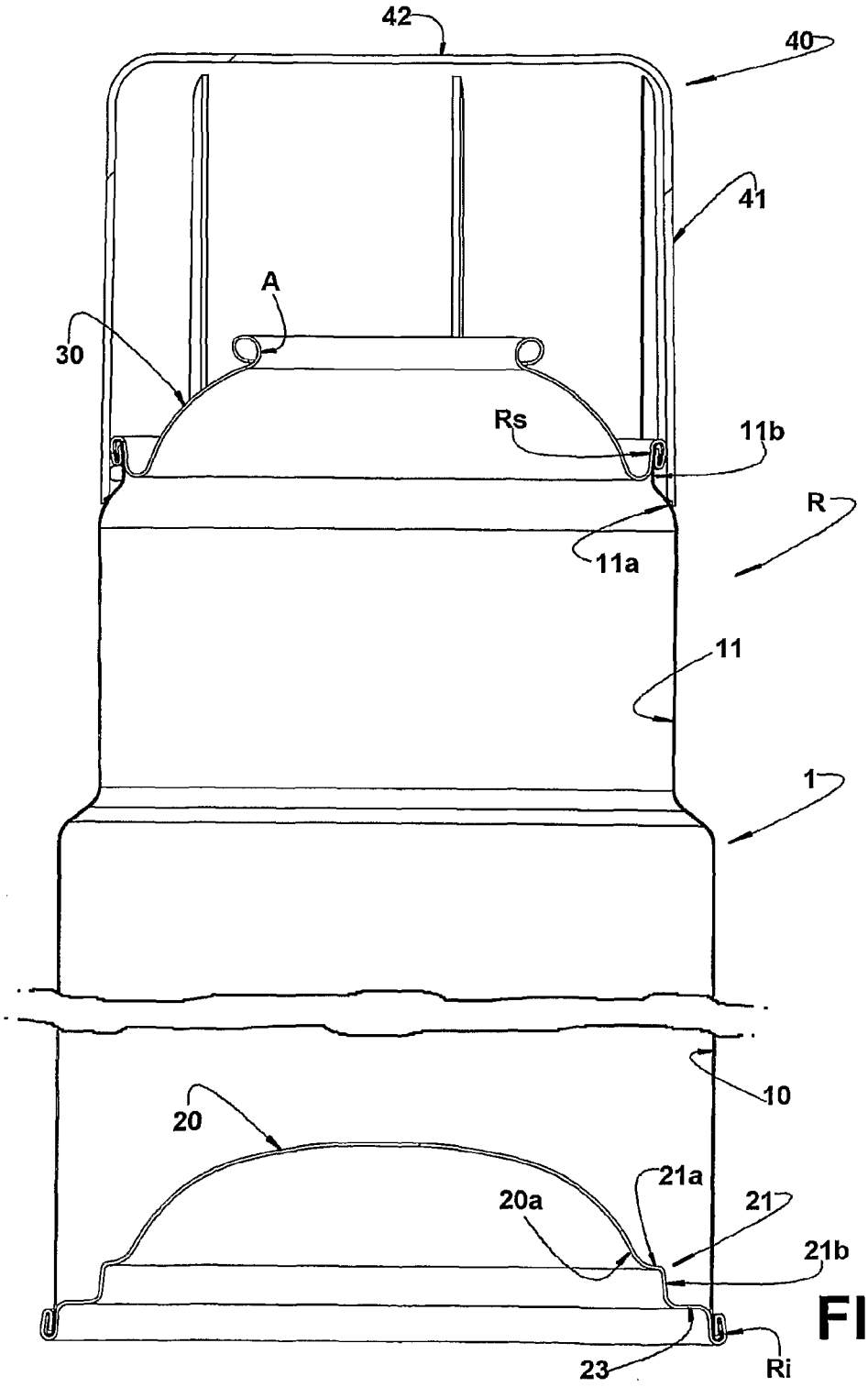
FIG. 3 represents a longitudinal diametrical sectional view of a container constructed with the bottom wall illustrated in FIGS. 1, 1A, 1B and 1C and carrying an upper lid fitted around the upper double seam of the container.
Figure 3A:
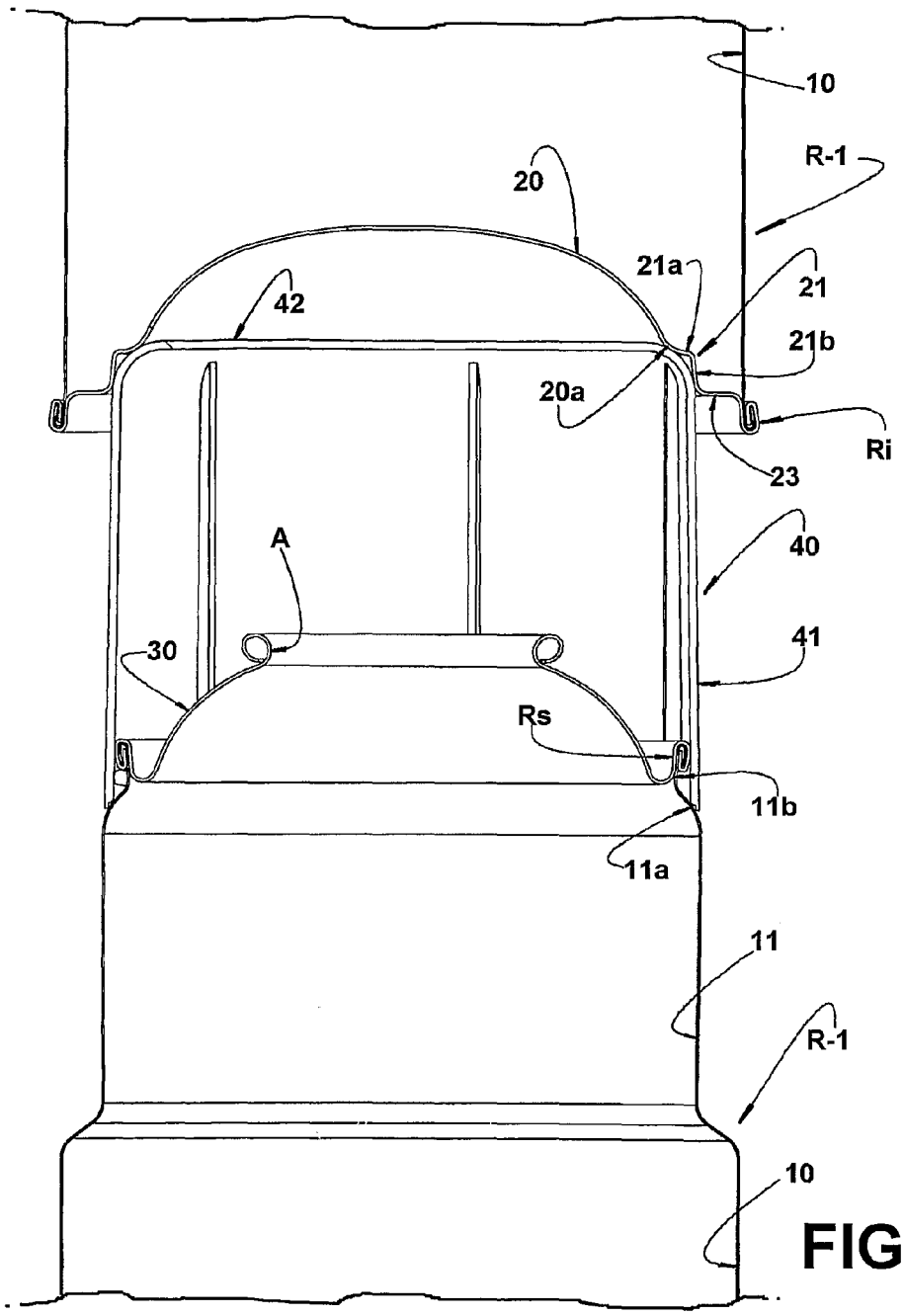
FIG. 3A represents an enlarged diametrical sectional view of the lower portion of a container, as defined in FIGS. 1, 1A, 1B, and 1C and with its bottom wall seated on the upper lid of an identical container disposed immediately below in a stack.
Figure 3B:
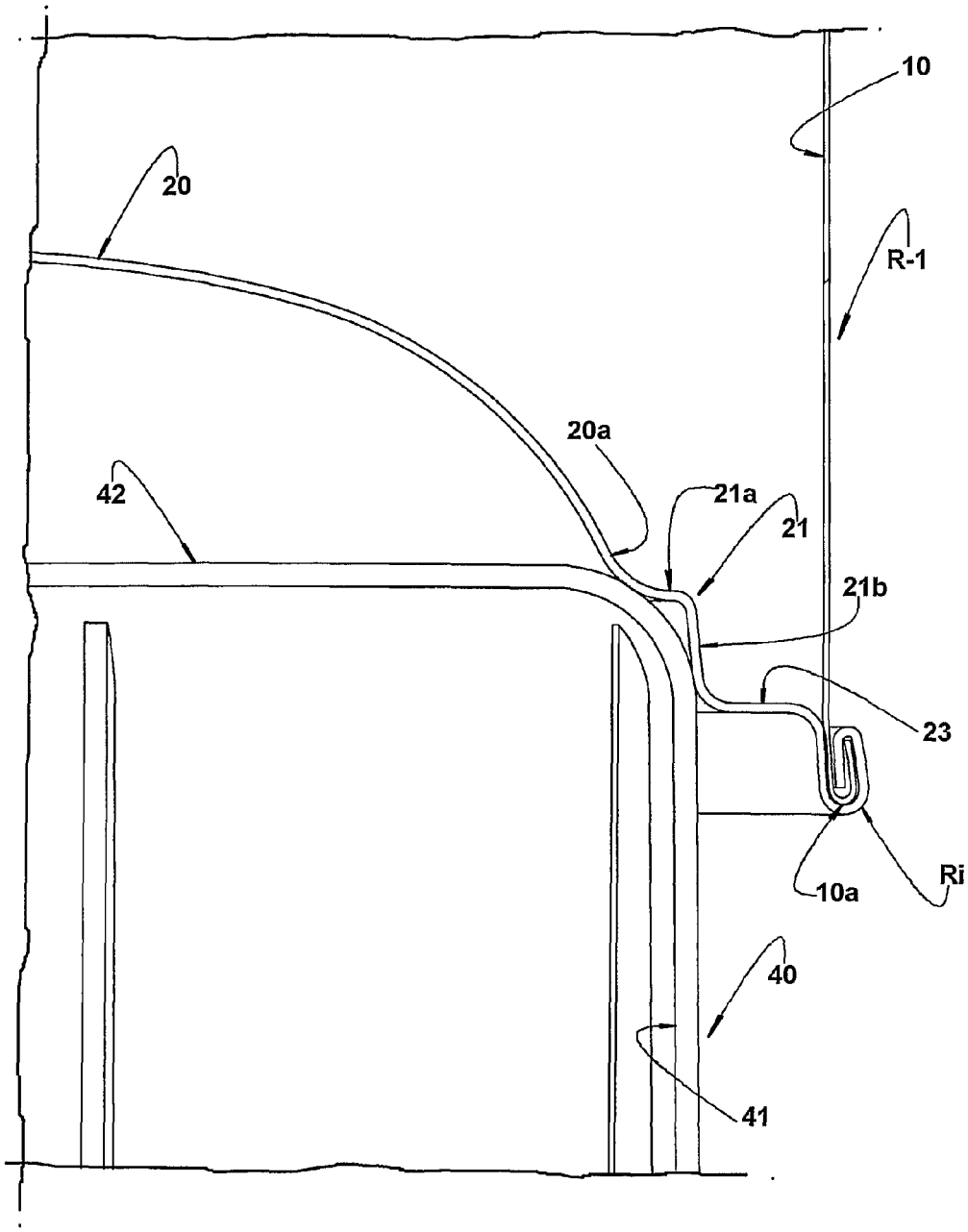
FIG. 3B represents an enlarged detail of part of FIG. 3A, to better illustrate the seating of the bottom wall on the lid of the inferiorly disposed container.
Figure 3C:
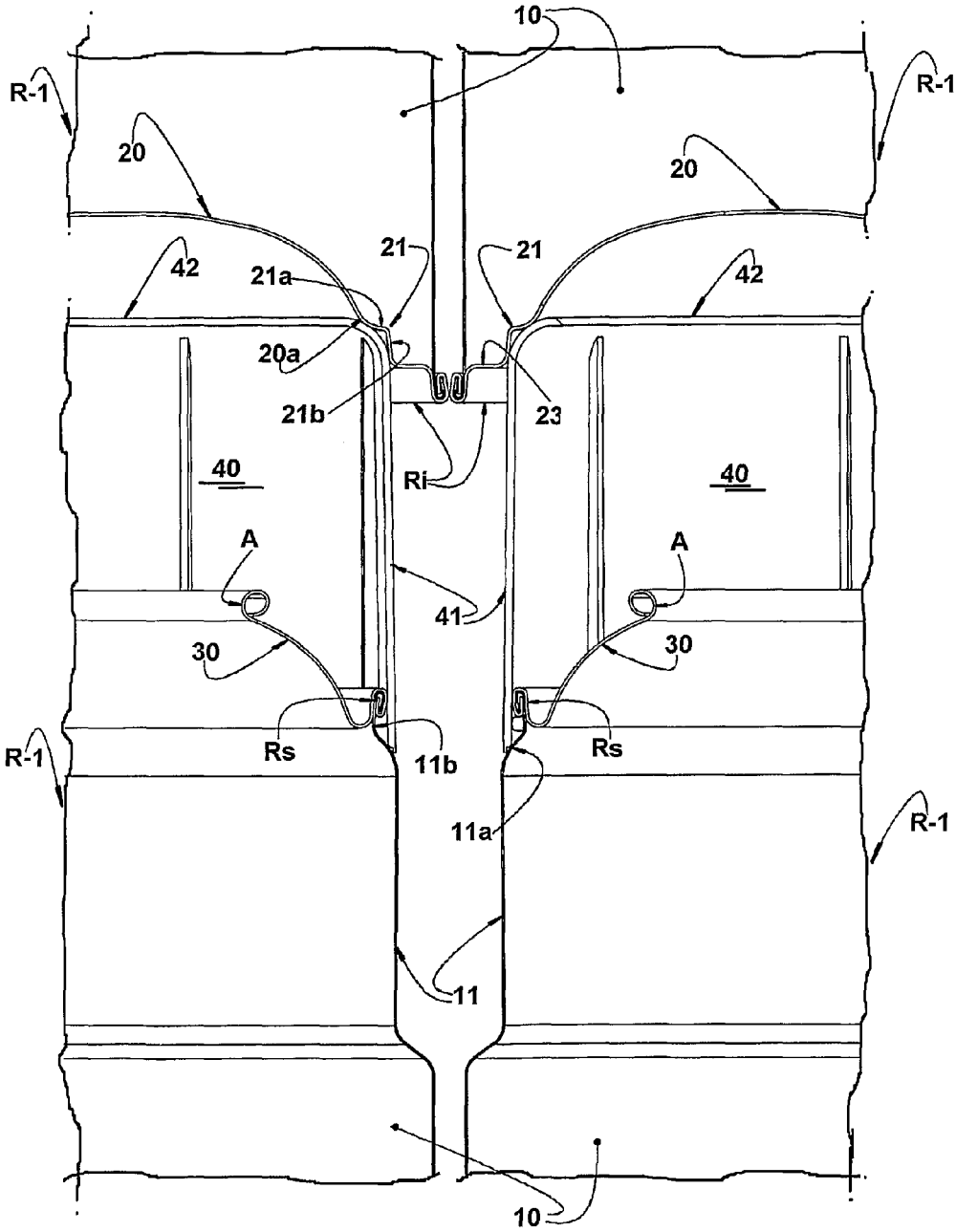
FIG. 3C represents a view similar to that of FIG. 3A, but illustrating two vertical stacks, which are partially sectioned and adjacently disposed.

As better illustrated in FIGS. 3, 3A and 3B, the container R is provided with a lid 40 in the form of a generally cylindrical inverted cup, having a side wall 41 whose lower portion is removably tightly fitted around the upper double seam Rs of the container R, and a top wall 42, which is spaced from the upper wall 30 of the container R, covering the central opening A, in which is usually mounted, by the filling company of the product to be contained in the container R, a spray valve (not illustrated) of known construction and which does not form part of the present invention. Considering the height in which said spray valve projects upwards from the central opening A, the lid 40 presents a height sufficient to be simultaneously seated on the transition portion 11*a* of the upper cylindrical portion 11 of the side wall 10 and superiorly spaced from the spray valve.

Figure 1A:
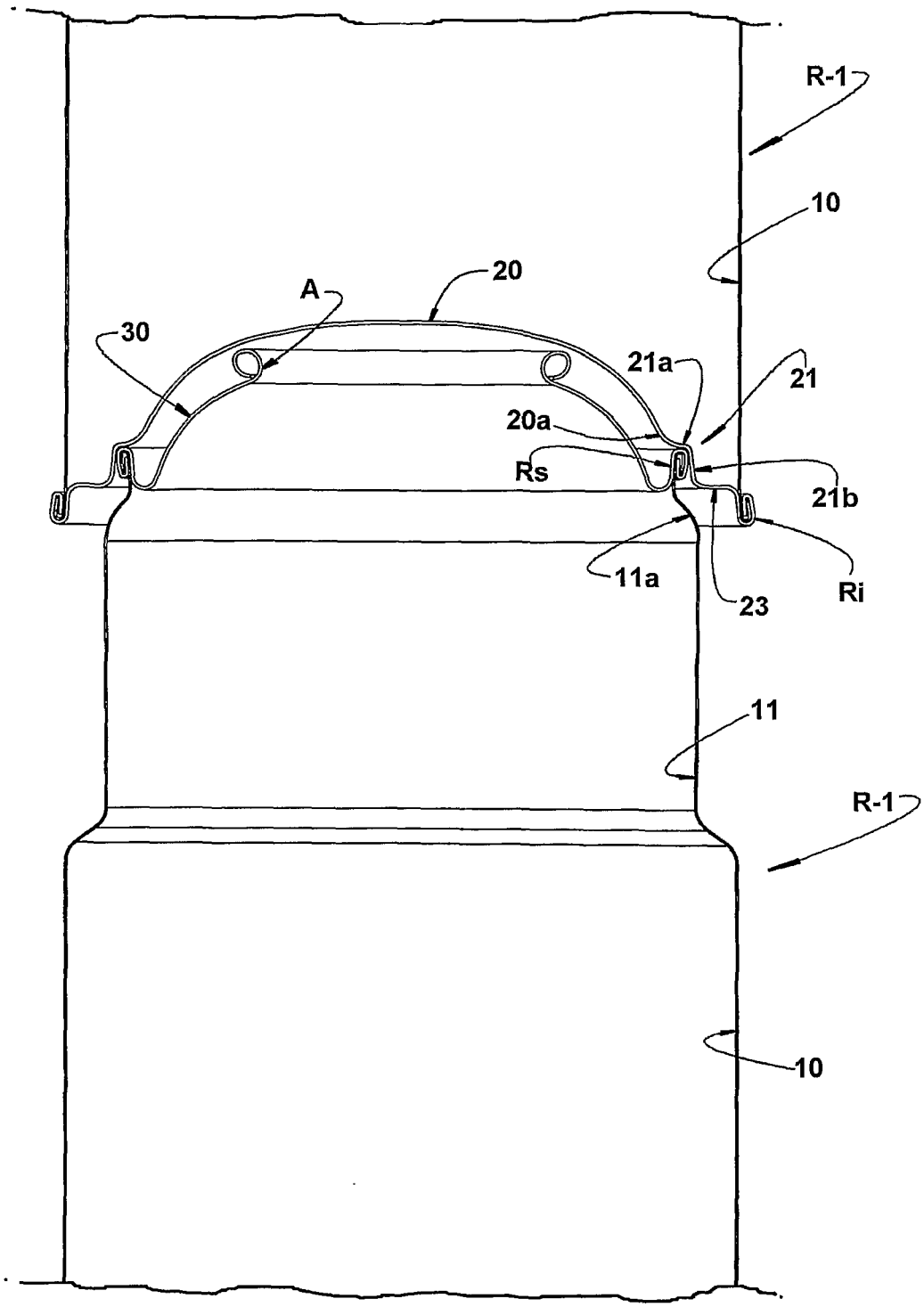
FIG. 1A represents an enlarged diametrical sectional view of the lower portion of a container, as defined in FIG. 1 and with a bottom wall seated on the upper double seam of a container presenting the same construction.
Figure 1B:
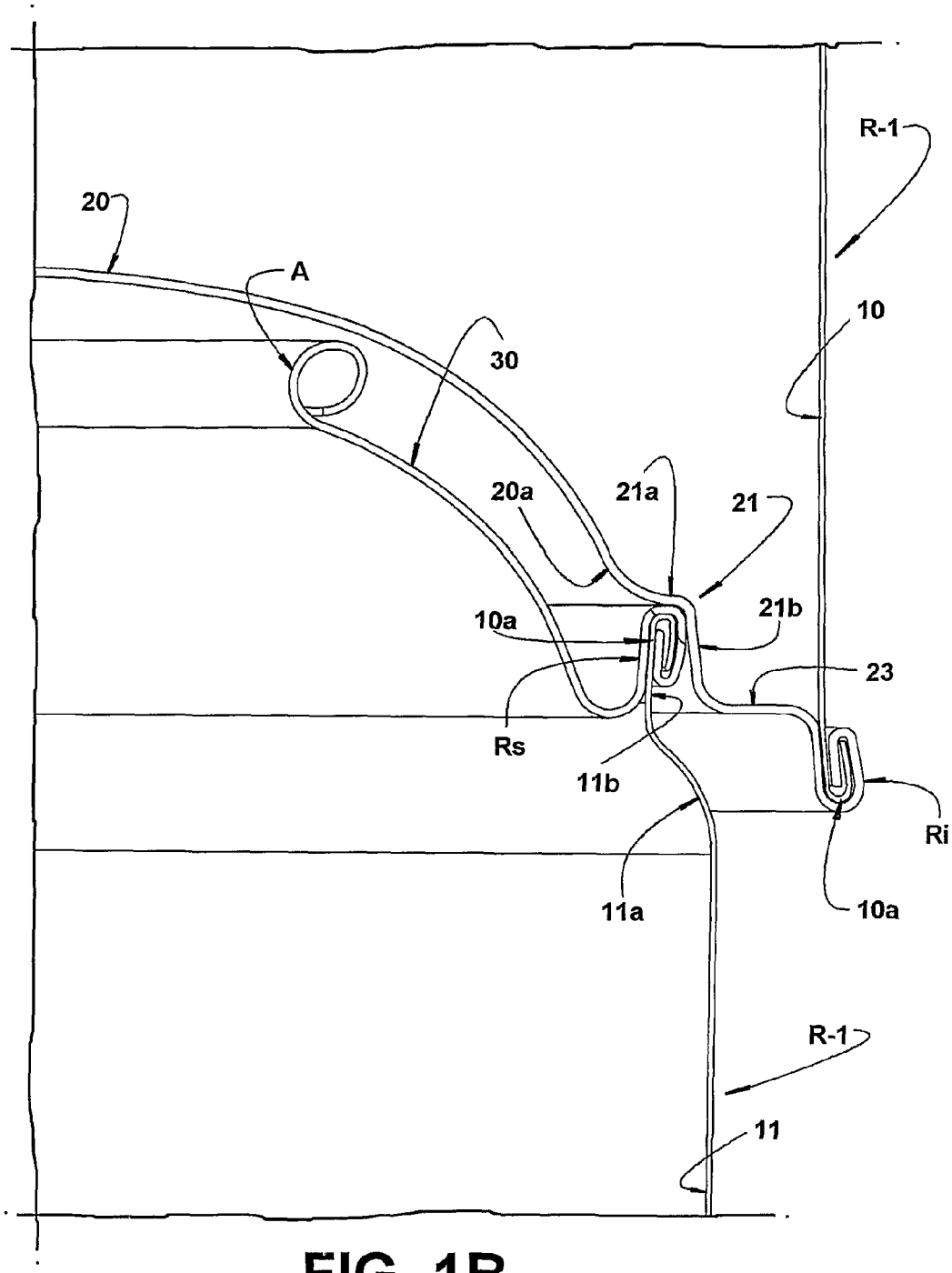
FIG. 1B represents an enlarged detail of part of FIG. 1A, to better illustrate the construction of the bottom wall and its seating on the upper double seam of the container inferiorly disposed in a stack.
Figure 1C:
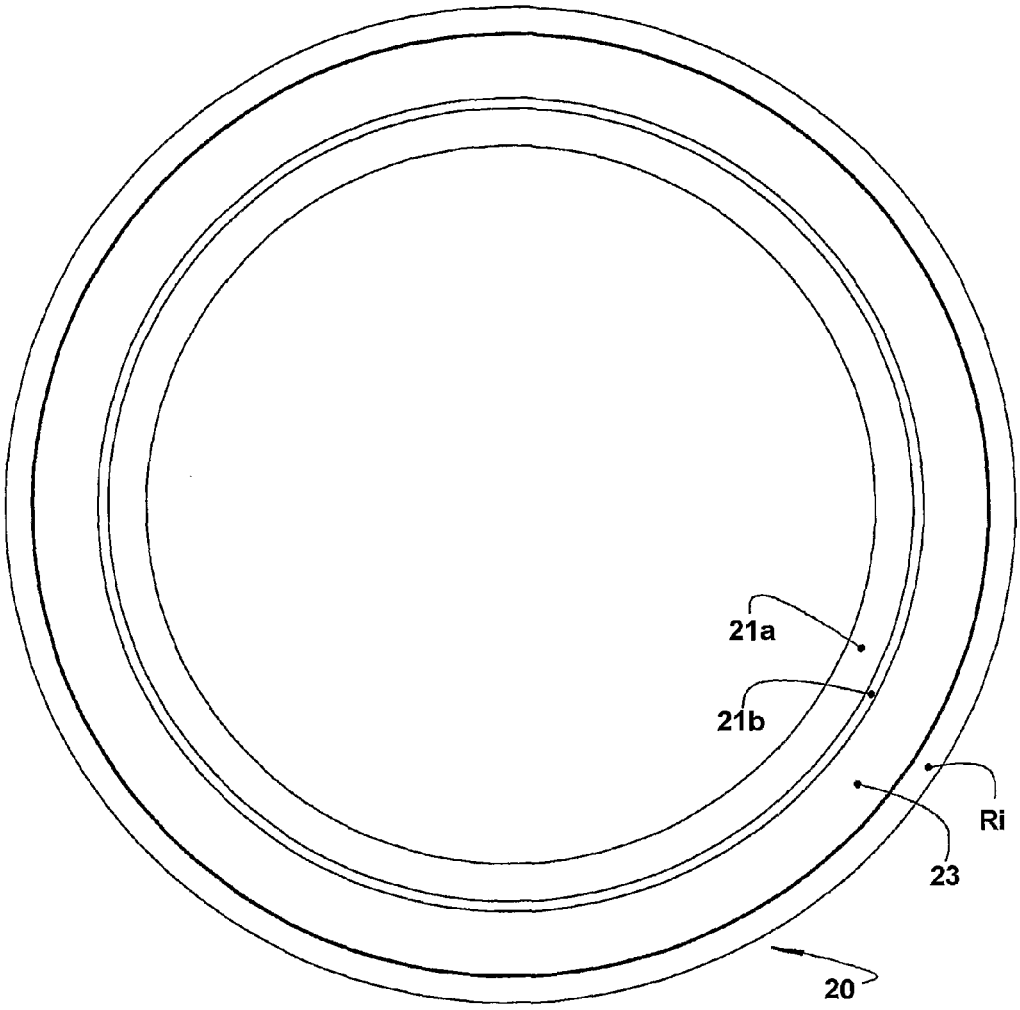
FIG. 1C represents a slightly enlarged bottom plan view of the first embodiment of the bottom wall, as illustrated in FIGS. 1, 1A and 1B.
Figure 1D:
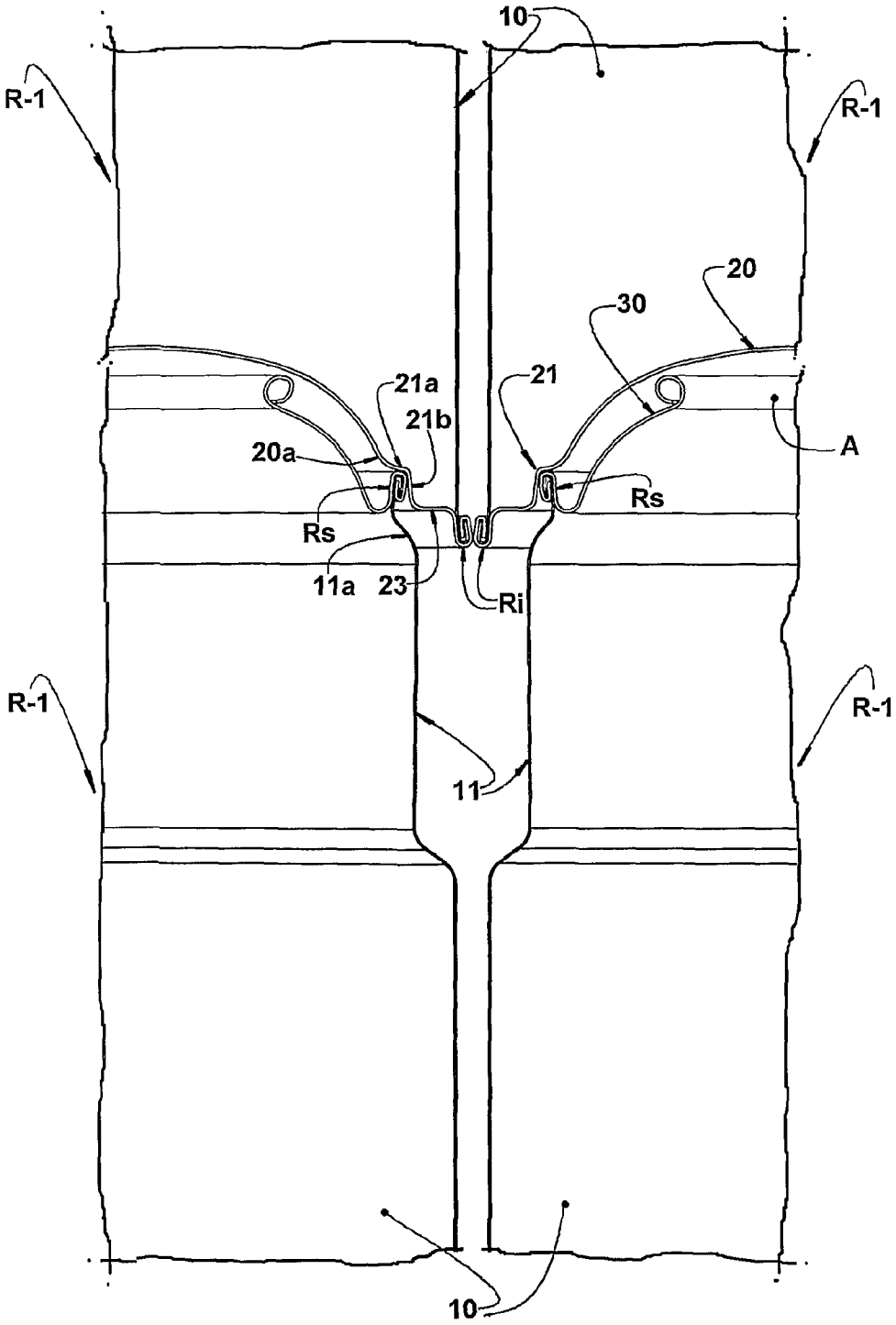
FIG. 1D represents a view similar to that of FIG. 1A, but illustrating two vertical stacks, which are partially sectioned and adjacently disposed.

As illustrated in FIGS. 1, 1A, 1B and 1C, in a first constructive embodiment, the container R has its bottom wall 20 provided, in a single piece, with only one seating region 21 which continuously circumferentially extends along the whole circular contour of the container R and comprising an annular axial stop portion 21*a*, to be seated onto the upper double seam Rs of a container R inferiorly disposed in a vertical stack of said containers, and also a guiding skirt portion 21*b* pending from the annular axial stop portion 21*a* to be fitted around the upper double seam Rs of said container R inferiorly disposed in the stack. The construction described above allows the container R to have its bottom wall 20 safely fitted and retained against relative radial displacements, on the upper double seam Rs of a container disposed immediately below, said seating region 21 defining a single contact region between the two containers R. It should be understood herein that the stacking solution illustrated in FIGS. 1A and 1B is related to those containers R produced by the can manufacturer and still deprived of the spray valve and the lid 40, since these elements will be afterwards mounted in the container R by the filler of the product to be stored. In the construction illustrated in FIGS. 1, 1A, 1B and 1C, in which the bottom wall 20 presents only one continuous seating region 21, said bottom wall 20 presents a lower peripheral edge 20*a* radially extending, in a single piece, in said annular axial stop portion 21*a*, the guiding skirt portion 21*b* being inferiorly connected to the lower double seam Ri, through an annular wall portion 23 spaced back in relation to the lower edge 10*a* of the cylindrical side wall 10 of the container R.

As better illustrated in FIG. 1B, the radial width of the annular wall portion 23 is larger than the diametral reduction of the upper edge 10*b* of the side wall 10 in relation to the adjacent upper cylindrical portion 11 thereof, so as to maintain the lower double seam Ri of a container R radially outwardly spaced from said upper cylindrical portion 11 of the side wall 10 and another container R disposed immediately below the former, when said containers are vertically stacked.

Preferably, the guiding skirt portion 21*b* of the seating region 21 presents a substantially frusto-conical shape, with the smaller inner diameter being substantially identical or slightly superior to the outer diameter of the upper double seam Rs. This construction of the guiding skirt portion 21*b* permits obtaining a tightly fitting between the bottom wall of the upper container R on the upper double seam Rs of the immediately lower container R, even considering the determined dimensional tolerances used in the manufacture of said container and, particularly, in the double seams thereof.

In the construction illustrated in FIGS. 1, 1A, 1B and 1C, it may be observed that the bottom wall 20 presents its spherical dome portion occupying only a median region of the whole contour of the base of the container R, since the seating region 21, in conjunction with the annular wall portion 23, complement the radial extension of the median central spherical dome. In other words, the bottom wall 20 has its spherical dome defined radially internal to the annular region defined by the junction of the single seating region 21 with the annular wall portion 23. As may be observed in FIGS. 1*a* and 1B, the construction of the bottom wall 20, by incorporating the seating region 21, allows stacking two of these containers R deprived of the spray valve and the lid 40, in a way as to prevent any contact with the upper wall 30 of the lower container R with the bottom wall 20 of the upper container R in the stack, and also any contact of the region of the lower double seam Ri of the upper container R in relation to the side wall 10 of the lower container R.

FIGS. 3, 3A, 3B and 3C illustrate the container R of FIGS. 1, 1A, 1B and 1D, when provided with the lid 40 and to be vertically stacked in this condition, as desired by the filling company of the product and also by the points of sales, since the solution proposed herein permits that the containers R provided with the lid 40, surrounding the upper part of the container and the spray valve, can be safely stacked without risk of dropping and damaging the side surface finishing of said containers.

As may be better noted in FIGS. 3, 3*a*, 3B and 3C, the annular axial stop portion 21*a* of the bottom wall 20 of a container R is axially seated on a peripheral region of the top wall 42 of the lid 40 of a container R inferiorly disposed in a vertical stack of said container R, whereas the guiding skirt portion 21*b* of the bottom wall 20 of the upper container R is tightly fitted around an upper edge region of the side wall 41 of the lid 40 of the container R immediately inferiorly disposed in said stack.

As can be seen, the frusto-conical shape of the guiding skirt portion 21*b* of the seating region 21, allows the latter to be seated around the lid 40, producing a mutual radial locking between the two containers, even considering the dimensional tolerance variations of the elements constitutive of these containers. Thus, the guiding skirt portion 21*b* of frusto-conical shape presents the smaller inner diameter smaller than the outer diameter of the side wall 41 of the lid 40 and the larger inner diameter larger than the inner diameter of said side wall 41 of the lid 40, in an upper edge region of the latter, in which it is connected to the top wall 42. FIGS. 2, 2A, 2B and 2C illustrate a second constructive form for the bottom wall 20 of the container R. In this second embodiment, the bottom wall 20 presents at least three seating regions 21 which are equally and angularly spaced apart along the circular contour of the container R, said seating regions 21 projecting downwards from the contour of the bottom wall 20 in the form of a spherical dome. As may be observed in this embodiment, the bottom wall 20 has the lower edge of its spherical dome shape directly connected to the lower double seam Ri, the multiple seating regions 21 being obtained by localized deformations of said spherical dome shape of the bottom wall 20.

The construction of each seating region 21 is the same as that already previously described for the first embodiment illustrated in the other figures commented herein. However, in this second embodiment, the annular axial stop portion 21*a* of each seating region 21 is connected to the bottom wall 20, by an arched wall portion 22 superiorly coincident with the bottom wall 20 and inferiorly coincident with the annular axial stop portion 21*a*, the guiding skirt portion 21*b*, of each seating region 21 also being inferiorly connected to the lower double seam Ri by an annular wall portion 23 spaced back in relation to the lower edge 10*a* of the cylindrical side wall 10.

It should be understood that the seating of the multiple seating regions 21, on the upper double seam Rs or on the lid 40 of a container R disposed immediately below in a vertical stack of said containers, is carried out exactly in the same way already described in relation to the first embodiment of the bottom wall 20. However, it should be considered that the support region between the bottom wall of the upper container and the upper double seam Rs or the lid 40 of the lower container is defined not around the whole circumference of the containers, but only in the circumferential extensions defined in each of the seating regions 21.

As illustrated in the enclosed drawings, and independently of the embodiment of the seating region 21, either single or multiple, its incorporation, in a single piece, to the bottom wall 20 is made through the arched interconnection regions, in order to prevent stress concentrations which are harmful to the resistance required for said bottom wall 20 as a function of the pressure levels maintained in the interior of this type of container R.

While only two embodiments of the invention have been illustrated herein for the construction of the bottom wall 20 of the containers R of the present invention, it should be understood that alterations can be made in the form and physical arrangement of the elements used in the formation of said seating regions 21, without departing from the constructive concept defined in the claims accompanying the present specification.

The invention claimed is:

1. A container for pressurized fluids, having a tubular body formed in sheet metal and comprising:

a cylindrical side wall, having a lower edge and an upper edge which presents a reduced diameter:

a bottom wall in the form of a spherical dome projecting to an interior of the container and attached to the lower edge of the side wall by a lower double seam; and an upper wall comprising a first annular wall portion and a spherical dome portion, inferiorly attached to the upper edge of the side wall by an upper double seam and defining a central opening, the container being characterized in that the bottom wall is configured, in a single piece to include at least one seating region having a predetermined circumferential extension disposed according to a plane extending transversely with respect to an axis of the container and being axially spaced inwardly within the side wall of the container in relation to the lower double seam, said seating region being configured to be fitted and axially seated respectively around and on a respective circumferential extension of the upper double seam of an identical and adjacent container inferiorly disposed in a vertical stack, so as to define a single contact region between two vertically stacked containers, the seating region comprising an annular axial stop portion, to be seated onto a container inferiorly disposed in the vertical stack, and a guiding skirt portion pending from the annular axial stop portion and to be fitted, around the upper double seam of the container inferiorly disposed in the vertical stack, the guiding skirt portion, of each seating region, being inferiorly connected to the lower double seam, by a second annular wall portion spaced back in relation to the lower edge of the cylindrical side wall, wherein, the radial width of the second annular wall portion is larger than the diametric reduction of the upper edge of the side wall, in relation to an adjacent upper cylindrical portion of the side wall, so as to maintain the lower double seam of a container radially outwardly spaced from the upper cylindrical portion of the side wall of another container disposed immediately below the second annular wall portion, when the container is in a vertical stack of similar containers, and the seating region, in conjunction with the second annular wall portion, complement a radial extension of the spherical dome of the bottom wall.

2. The container, as set forth in claim 1, characterized in that the annular axial stop portion of the seating region is provided in order to be seated onto the upper double seam of the container inferiorly disposed in the vertical stack.

3. The container, as set forth in claim 2, wherein the bottom wall presents at least three identical seating regions which are equally equi-angularly spaced apart along a circular contour of the container, said seating regions projecting downwardly from the contour of the bottom wall in the form of a spherical dome.

4. The container, as set forth in claim 3, wherein the annular axial stop portion of each seating region is connected to the bottom wall by an arched wall portion superiorly coincident with the bottom wall and inferiorly coincident with the annular axial stop portion.

5. The container, as set forth in claim 4, wherein the guiding skirt portion of the seating region presents a substantial frusto-conical shape, with a smaller inner diameter of the guiding skirt portion being substantially identical to an outer diameter of the upper double seam.

6. The container, as set forth in claim 1, said container arraying a lid in the form of an inverted cylindrical cup, having a side wall whose lower portion is removably tightly fitted around the upper double seam of the container, and a top wall spaced from the upper wall of the container, said container being characterized in that the seating region is fitted around a respective circumferential extension of an upper edge region of a side wall of the lid and axially seated on a respective circumferential extension of a peripheral region of the top wall of the lid of the other container inferiorly disposed in a vertical stack, said seating region defining a single contact region between the two stacked containers.

7. The container, as set forth in claim 6, wherein the seating region comprises:

an annular axial stop portion to be axially seated on a respective circumferential extension of a peripheral region of the top wall of the lid of the container inferiorly disposed in the vertical stack of said containers provided with respective lids; and a guiding skirt portion pending from the annular axial stop portion and to be tightly fitted around a respective circumferential extension of an upper edge region of the side wall of the lid of said container immediately below.

8. The container, as set forth in claim 7, wherein the bottom wall presents at least three identical seating regions that are equi-angularly spaced apart along a circular contour of the container, said seating regions projecting downwardly from the contour of the bottom wall in the form of a spherical dome.

9. The container, as set forth in claim 8, wherein the annular axial stop portion of each seating region is connected to the bottom wall by an arched wall portion, superiorly coincident with the bottom wall and inferiorly coincident with the annular axial stop portion, the guiding skirt portion of each seating region being inferiorly connected to cylindrical side wall.

10. The container, as set forth in claim 1, wherein at least one seating region of the bottom wall extends continuously along the entire circular contour of the container and includes an annular axial stop portion, configured to be seated onto the upper double seam of a container inferiorly disposed in a vertical stack, and a guiding skirt portion pending from the annular axial stop portion and configured to be fitted around the upper double seam of said container inferiorly disposed in the stack.

11. The container, as set forth in claim 10, wherein the bottom wall presents a lower peripheral edge which extends radially in a single piece, in the annular axial stop portion.

12. The container, as set forth in claim 11, wherein the guiding skirt portion of the seating region presents a substantial frusto-conical shape, with a smaller inner diameter of the guiding skirt portion being substantially identical to an outer diameter of the upper double seam.

13. The container, as set forth in claim 11 and carrying a lid (40) in the form of an inverted cylindrical cup, having a side wall whose lower portion is removably tightly fitted around the upper double seam of the container, and a top wall spaced from the upper wall of the container covering the latter, the container being characterized in that the annular axial stop portion is axially seated on a peripheral region of the top wall of the lid of a container inferiorly disposed in a vertical stack of said containers provided with respective lids, whereas the guiding skirt portion is tightly fitted around an upper edge region of the side wall of the lid of said container immediately inferiorly disposed in the stack.

14. The container, as set forth in claim 13, wherein the guiding skirt portion of the seating region presents a substantial frusto-conical shape, having a smaller diameter and a larger inner diameter respectively smaller and larger than an outer diameter of the side wall of the lid, in its upper edge region, in which it is connected to the top wall.

* * * * *